US009716356B2

(12) United States Patent
Hsieh

(10) Patent No.: US 9,716,356 B2
(45) Date of Patent: Jul. 25, 2017

(54) ELECTRICAL RECEPTACLE CONNECTOR

(75) Inventor: Chang-Cheng Hsieh, Taipei (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/391,407

(22) PCT Filed: Jun. 11, 2012

(86) PCT No.: PCT/CN2012/076723
§ 371 (c)(1),
(2), (4) Date: Oct. 9, 2014

(87) PCT Pub. No.: WO2013/185280
PCT Pub. Date: Dec. 19, 2013

(65) Prior Publication Data
US 2015/0118906 A1 Apr. 30, 2015

(51) Int. Cl.
*H01R 13/648* (2006.01)
*H01R 24/70* (2011.01)
*H01R 13/627* (2006.01)

(52) U.S. Cl.
CPC ..... *H01R 24/70* (2013.01); *H01R 13/6271* (2013.01)

(58) Field of Classification Search
CPC .. H01R 24/70; H01R 13/6271; H01R 13/648; H01R 13/627; H01R 13/6397; H01R 13/6275
USPC ..... 439/607.01
See application file for complete search history.

(56) References Cited

U.S. PATENT DOCUMENTS 4,897,005 A * 1/1990 Peterson et al. ..... 411/175
5,676,569 A * 10/1997 Davis ..... H01R 13/518 439/540.1
5,766,041 A * 6/1998 Morin ..... H01R 13/65802 439/607.19
6,902,432 B2 * 6/2005 Morikawa et al. ..... 439/607.41
6,919,505 B2 7/2005 Cox
7,914,304 B2 3/2011 Cartier et al.
(Continued)

FOREIGN PATENT DOCUMENTS

CN 101727960 A 6/2010
CN 201608292 U 10/2010
(Continued)

OTHER PUBLICATIONS

"USB 3,0* Radio Frequency interference Impact on 2.4 GHz Wireless Devices"; Apr. 2012; 22 pages.
(Continued)

*Primary Examiner* — Jean F Duverne
(74) *Attorney, Agent, or Firm* — HP Patent Department

(57) ABSTRACT

An electrical receptacle connector for electrically connecting with a mating plug connector is disclosed. The electrical receptacle connector comprises an enclosure which has an upper wall and a lower wall at least one of which comprises a spring clip. The spring clip defines at its end an engaging head bending towards inside of the enclosure, and a bending angle of the engaging head is made to be greater than or equal to a certain threshold so that when said electrical receptacle connector connects with said plug connector, the spring clip and a metal area around a receiving member where the engaging head is received on the mating plug connector contact with each other.

20 Claims, 4 Drawing Sheets

(56) References Cited

U.S. PATENT DOCUMENTS

| | | | | |
|---|---|---|---|---|
| 7,953,175 | B2 | 5/2011 | Hariton et al. | |
| 7,963,773 | B2 | 6/2011 | Palli et al. | |
| 8,083,535 | B2 * | 12/2011 | Chang | 439/357 |
| 8,439,708 | B2 * | 5/2013 | Colantuono et al. | 439/660 |
| 2010/0297878 | A1 * | 11/2010 | Su et al. | 439/607.01 |
| 2012/0030400 | A1 | 2/2012 | Kim et al. | |
| 2012/0184137 | A1 * | 7/2012 | Patel et al. | 439/607.01 |
| 2013/0045629 | A1 * | 2/2013 | Zhu | H01R 13/6582 439/607.55 |

FOREIGN PATENT DOCUMENTS

| | | | |
|---|---|---|---|
| CN | 201629421 | U | 11/2010 |
| CN | 102165857 | A | 8/2011 |

OTHER PUBLICATIONS

International Search Report and Written Opinion received in related PCT Application No. PCT/CN2012/076723, mailed Mar. 21, 2013, 13 pg.

* cited by examiner

ELECTRICAL RECEPTACLE CONNECTOR

BACKGROUND

Compared with its previous versions USB1.0 and USB2.0, USB 3.0 delivers an unprecedented bandwidth, 10 times that of USB 2.0, and supports full-duplex communication, or the ability to send and receive data simultaneously. It also improves Quality of Service (QoS) and overall bus power consumption thanks to advanced data error checking coupled with smart power savings from USB 3.0 link power management.

Accordingly, various electrical connectors including receptacle connectors and their counterpart plug connectors have been designed for use with USB3.0.

BRIEF DESCRIPTION OF THE DRAWINGS

The accompanying drawings illustrate various examples of various aspects of the present disclosure. It will be appreciated that the illustrated element boundaries (e.g., boxes, groups of boxes, or other shapes) in the figures represent one example of the boundaries, it will be appreciated that in some examples one element may be designed as multiple elements or that multiple elements may be designed as one element. In some examples, an element shown as an internal component of another element may he implemented as an external component and vice versa.

DETAILED DESCRIPTION

Modern portable computers (e.g. notebook computer or laptop) or desktop computers are often provided with a plurality of communication interfaces or modules to operate in different frequency ranges according to different protocols. Examples of such interfaces or modules comprises a Bluetooth interface, a WLAN interface, a USB3.0 interface, etc. It has been recognized that, due to high speed transmission (with an actual transmission rate of 3.2 Gbps and a maximum of 5.0 Gbps) of USB 3.0, the noise strength of differential signals of USB3.0 is much higher than that of USB2.0 device, about 30 dbm higher from 1 GHz to 3 GHz. This noise can radiate from the USB3.0 connector on a PC platform (i.e. a USB3.0 receptacle connector), the USB3.0 connector on the peripheral device (i.e. a USB3.0 plug connector) or the USB 3.0 cable. Therefore, when a USB3.0, which is a high speed serial bus standard, device plugs into (i.e. connects to) for example a notebook computer, this kind of high speed operation of USB3.0 device would probably severely affect its nearby wireless devices.

For example, when there are two USB3.0 ports on a notebook computer, with one of the USB 3.0 ports being plugged by a USB3.0 Hard Disk Drive (HDD) and another USB3.0 port being plugged by a USB2.0 proprietary wireless mouse transceiver, the noise interference issue would happen. The mouse's cursor would have a lag issue (i.e. cannot move smoothly) on the notebook's display. In addition, the detection range of the USB 2.0 mouse transceiver would degrade from 3-5 m to 0.5-1 m and the broad band noise coupling increases about. 20-30 db in adjacent to USB 3.0 port.

This noise of USB3.0 can also interfere with operations of other wireless modules such as a WLAN module and a Bluetooth module which are collocated in the notebook computer with the USB3.0 device, For example, for an embedded WLAN module, its throughput would be affected. For a Bluetooth device (e.g. a paired BT headset device), its detection range would degrade from 8 m to 5-6 m.

In the following, examples of a USB3.0 receptacle connector according to the present disclosure will be described with reference to the drawings. These exemplary USB3.0 receptacle connectors can reduce noise radiation resulting from USB3.0.

Figure 1:
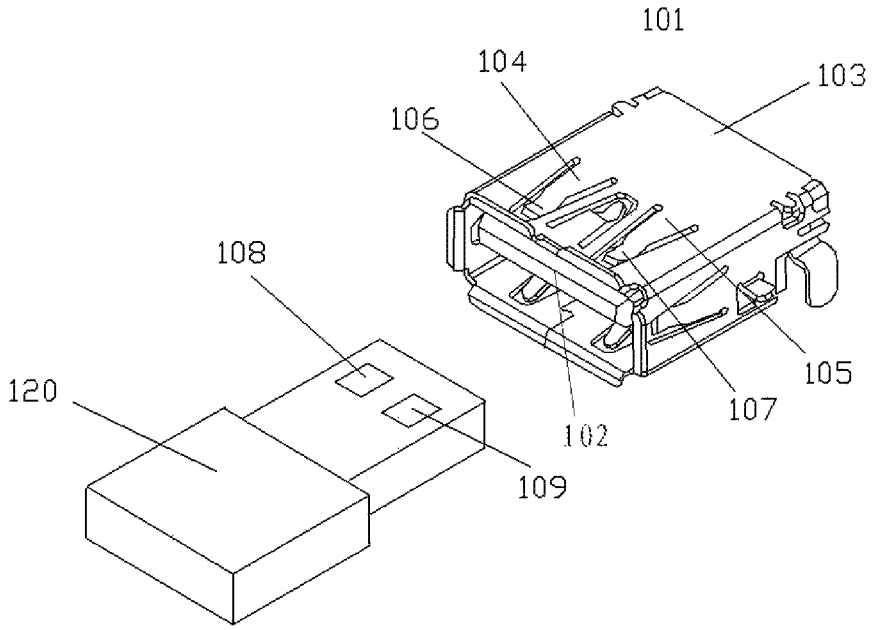
FIG. 1 illustrates a schematic diagram of a USB receptacle connector according to an example of the present disclosure, together with its mating plug connector.

With reference 1:0 FIG. 1, FIG. 1 illustrates a schematic diagram of a USB receptacle connector (which can be a USB3.0 connector herein) according to an example of the present disclosure, wherein FIG. 1 further shows a corresponding USB 3.0 plug connector that can connect with the USB 3.0 receptacle connector. As will be understood by those skilled in the art, although not shown, the USB3.0 receptacle connector in FIG. 1 can be mounted onto a computing device such as a personal computer and the USB3.0 plug connector can be connected to a USB3.0 peripheral device such as a USB3.0 HDD or flash memory.

As shown in FIG. 1, the USB3.0 receptacle connector 101 comprises an enclosure 103 and a body 102 received in the enclosure 103. There is provided a plurality of electrical connection terminals in the body, so as to electrically connect to corresponding terminals in a mating USB3.0 plug connector 120 when the USB3.0 receptacle connector 101 is connected with the USB3.0 plug connector 120, so that communication between a computing device connected to the USB3.0 receptacle connector 101 and a USB3.0 peripheral device connected to the USB3.0 plug connector 120 can be realized. The enclosure 103 includes an upper wall (i.e. upper surface) and a lower wall (i.e. a lower surface) opposite to it and also includes two side walls. As shown, the upper wall can include at least one spring clip, such as spring clips 104 and 105. Between spring clips 104 and 105 there can be another spring clip, which extends in an opposite direction to the spring clips 104 and 105. The spring clips 104 and 105 each defines an engaging head at its end, such as engaging heads 106 and 107. The engaging heads 106 and 107 extend towards inside of the enclosure 103.

Figure 2:
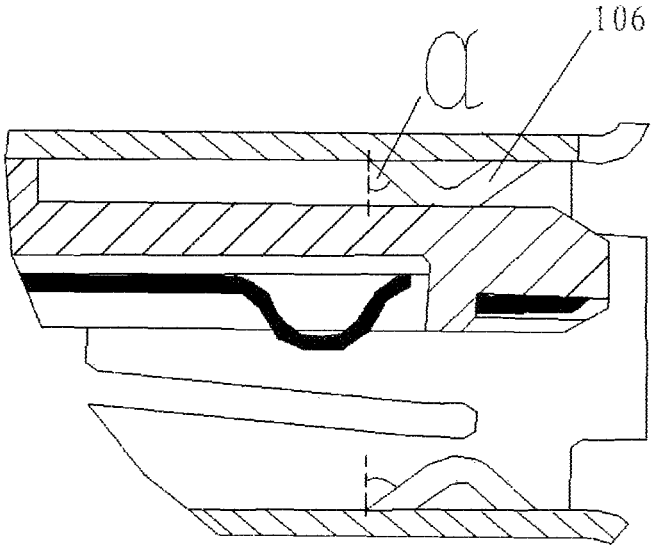
FIG. 2 illustrates a partial cross-section diagram of the USB receptacle connector shown in FIG. 1.

With reference to FIG. 2, FIG. 2 illustrates a partial cross-section diagram of the USB receptacle connector 101 shown in FIG. 1. As shown in FIG. 2, the engaging head 106 of the spring clip 104 bends towards inside of the enclosure 103. The engaging head 106 is shaped as a valley, which first extends downwardly in a tilting way and then rises up, so as to form a bump. As can be seen from FIG. 2, there is an angle formed between a vertical line (shown as dashed line in FIG. 2) and the portion of the engaging head 106 that is tilting downwardly. The angle is referred to as the bending angle of the spring clip and denoted as $\alpha$ in the present disclosure.

According to an example of the present disclosure, the bending angle $\alpha$ is made to be greater than or equal to a certain threshold, so that when the USB3.0 receptacle connector 101 and the mating USB3.0 plug connector 120 connect with each other, not only the engaging head 106 of the spring clips 104 can wedge into a receiving member (such as a hole) 108 on the USB3.0 plug connector 120 to fix these two components, but also the engaging head 106 and therefore the spring clip 104 can contact with an edge of the hole 108 on the USB3.0 plug connector 120, that is, contact with a metal area surrounding the hole 108 on the USB3.0 plug connector 120, in which case there will be electrical contact between the spring clip 104 and the plug connector 120.

It will be appreciated that although the above only describes the spring clip 104 and its engaging head 106, the other spring clip 105 on the upper wall of the USB3.0 receptacle connector 101 will also be similarly shaped and have the same bending angle. In addition, the lower wall of the enclosure 103 of the USB 3.0 receptacle connector 101 also includes a pair of spring clips. Similar to the spring clips 104 and 105 on the upper wall, engaging heads at respective ends of the spring clips on the lower wall also have the same bending angle so that when the USB3.0 receptacle connector 101 connects with a mating USB3.0 plug connector, these engaging heads on the lower wall also contact two holes on the corresponding side of the USB3.0 plug connector so as to fix them and contact edges of the holes and thus contact a metal area on the corresponding side of the USB3.0 plug connector, to realize a reliable interconnect grounding contact therebetween.

In this way, when the USB3.0 receptacle connector 101 connects with the mating USB3.0 plug connector 120, the engaging heads of all the spring clips on the upper wall and lower wall of the USB3.0 receptacle connector 101 can wedge into respective holes on corresponding sides of the plug connector and also contact with the metal area surrounding the holes on the USb3.0 plug connector. As such, contact between the spring clips and the holes not only secures the corresponding USB3.0 plug connector 120 to the USB3.0 receptacle connector 101, but also can form a reliable interconnect grounding contact between the spring clips and the metal area of the plug connector.

In an example of the present disclosure, the threshold for the bending angle of the spring clips can be set to 45 degrees to ensure contact between the spring clips and the metal area. However, those skilled in the art can is select another suitable threshold value for the bending angle based on considerations such as the form factor of the receiving members on the corresponding USB3.0 plug connector, as long as it can ensure positive contact between the spring clips and the metal area. According to an example of the present disclosure, the bending angle is in the range of 45-55 degrees.

According to an example of the present disclosure, by enabling each spring clip on the USB3.0 receptacle connector to contact with a metal area on the corresponding USB3.0 plug connector, the contact resistance between each spring clip and the metal area is less than about 1 milli-Ohm, so that the contact resistance between the whole USB3.0 receptacle connector (including four spring clips in the above example) and the USB3.0 plug connector is in the range of about 3 to 5 milli-Ohms. This not only significantly reduces the contact resistance but also makes the contact resistance become more stable from one connector to another connector due to multi-point contact. Alternatively, the surface of the corresponding plug connector can be covered with an aluminum foil to achieve such low contact resistance between the plug and receptacle sides of connectors.

Figure 3:
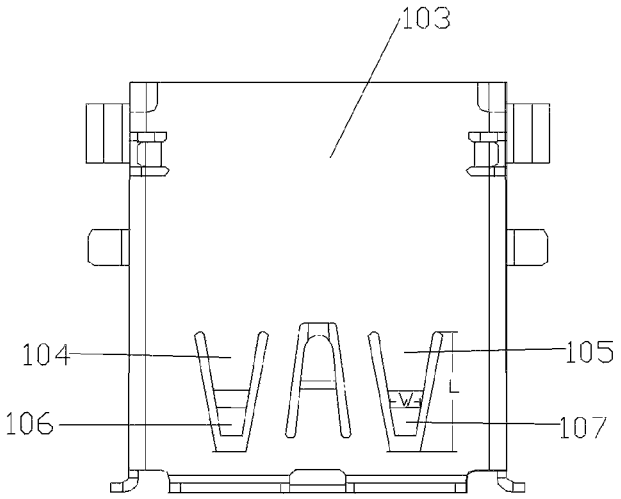
FIG. 3 illustrates a top view of the USB receptacle connector shown in FIG. 1.

With reference to FIG. 3, FIG. 3 illustrates a top view of the USB receptacle connector shown in FIG. 1. As shown in FIG. 3, the length of a spring clip such as 105 is defined as the length of space that houses the spring clip on a (upper) wall of the USB3.0 receptacle connector and denoted as L herein, and the width of the spring clip is defined as the width of the lowest part of the valley-shaped engaging head (or the highest part of the engaging head, if it is on the lower wall) and denoted as W herein. According to an example of the present disclosure, for a spring clip such as 104 or 105 described above, the ratio of its length and width is set to be less than or equal to 2:1. For example, the length of the spring clip can be 4 mm, and the width can be 2 m or more; or the length can be 2 mm, and the width can be 1 mm or more; or the length can be 5 mm, and the width can be 2.5 mm or more. Compared with a length-width ratio of 5:1, the spring clip according to this example can reduce inductance of the USB3.0 receptacle connector. As understood by those skilled in the art, the longer a spring clip is, the greater the inductance will be. According to this example of the present disclosure, as the ratio of the length and width of a spring clip is reduced, the inductance is also reduced. However, a smaller length-width ratio means that when the USB3.0 plug connector plugs into the USB3.0 receptacle connector, the resistance force it suffers will increase accordingly, which could result in a greater abrasion of the metal coated on the surface of the connector. Thus, those skilled in the art can select an appropriate length-width ratio accordingly. According to an example, reducing the ratio of length and width of a spring clip can be achieved by reducing the length of the spring clip or increasing its width. Also noted that those spring clips on sidewalls of the receptacle connector can also have such a length-width ratio of less than or equal to 2:1.

According to an example of the present disclosure, a spring clip is designed so that when the USB3.0 receptacle connector connects with the USB3.0 plug connector, the contact force between the spring clip and the metal area which it contacts is greater than about 100 milligrams (mg). Such a big contact force can ensure multiple-point grounding contact between the USB3.0 receptacle connector and the USB3.0 plug connector when they are connected, so that the contact resistance between them will become small and stable as described above, and thus noise radiation caused by USB3.0 will be decreased. The contact force of about 100 mg or more can be achieved by adjusting the length-width ratio of the spring clip and its bending angle. For example, with the ration being less than or equal to 2:1 and the angle being in the range of about 45-55 degrees, as described above, if the bending angle is increased, then the contact force realized under the same length-width ratio will be decreased accordingly, and vice versa. Those skilled in the art can choose appropriate length-width ratio and angle of the spring clips accordingly.

According to another example of the present disclosure, the material of at least one of the spring clip and the enclosure can be changed to reduce the contact resistance between the USB3.0 receptacle connector and the USB3.0 plug connector. For example, a material with a smaller conductivity (less than the conductivity of the steel typed material) can be selected to manufacture the spring clips or the enclosure. Examples of such material can include beryllium-copper typed material or gold. For example, the spring clips can be made of beryllium-copper typed material. Alternatively, the enclosure of the receptacle connector can be changed from steel to beryllium typed material. It will be appreciated that those skilled in the art can select other appropriate materials.

Figure 4:
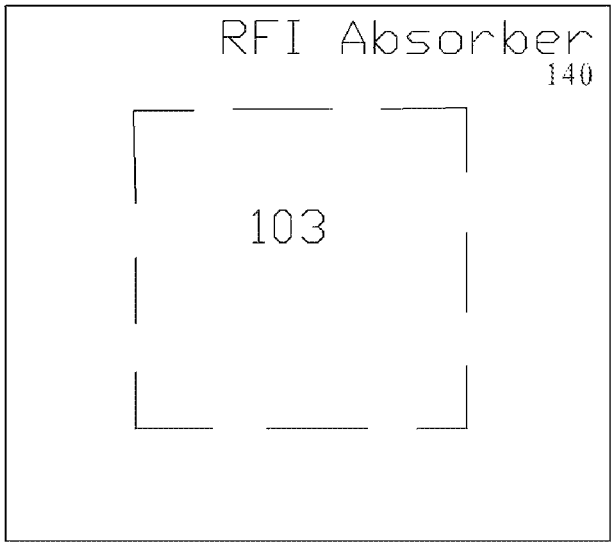
FIG. 4 illustrates a schematic diagram of another USB receptacle connector according to another example of the present disclosure.

With reference to FIG. 4, FIG. 4 shows a schematic view of a USB3.0 receptacle connector according to another example of the present disclosure. As shown in FIG. 4, the enclosure 103 of the USB3.0 receptacle connector can be surrounded by an ultrahigh frequency RFI absorber 140. In this way, effective magnetic field isolation can be achieved and the near field interference of USB3.0 can be lowered by about 10-15 dB, Examples of the RFI absorber that can be applied can include electroconductive rubber, conductive fabric, Conductive foam, conductive tape, beryllium copper finger, conductive pastes, EMI Shielding Tape, microwave absorption material, etc. Any suitable technique can be employed to apply the RFI absorber around the USB3.0 receptacle connector.

Although certain examples of USB3.0 receptacle connector are described above, it should be understood that the present invention can also apply to any other electrical receptacle connector such as USB2.0 or HDMI. It will be appreciated that many modifications can be made to the above examples without departing from the spirit and scope of the present invention and the appended claims intend to cover all these modifications.

The invention claimed is:

1. An electrical receptacle connector for electrically connecting with a mating plug connector, said electrical receptacle connector comprising:

a metal enclosure which has an upper wall and a lower wall at least one of which comprises a spring clip, wherein the metal enclosure further has a first side wall and a second side wall, the metal enclosure defining a space for insertion of the mating plug connector;

a body including a plurality of connection terminals, wherein the body is enclosed by the upper wall, the lower wall, the first side wall, and the second side wall of the metal enclosure; and a RFI absorber enclosing outer faces of the upper wall, the lower wall, the first side wall, and the second side wall of the metal enclosure, wherein the spring clip defines at its end an engaging head bending towards inside of the enclosure, and wherein a bending angle of the engaging head is made to be greater than or equal to a certain threshold so that when said electrical receptacle connector connects with said plug connector, the spring clip and a metal area around a receiving member where the engaging head is received on the mating plug connector contact with each other.

2. The electrical receptacle connector of claim 1, wherein said threshold is set to be 45 degrees.

3. The electrical receptacle connector of claim 2, wherein the bending angle is in the range of 45-55 degrees.

4. The electrical receptacle connector of claim 1, wherein a ratio of length and width of the spring clip is equal to or less than 2:1.

5. The electrical receptacle connector of claim 1, wherein the spring clip is made of beryllium-copper typed material.

6. The electrical receptacle connector of claim 1, wherein said electrical receptacle connector comprises a USB receptacle connector and both the upper wall and the lower wall include at least two spring clips respectively, and wherein the bending angles of engaging heads of said spring clips are all made to be no less than said threshold to ensure contact between the spring clips and the metal area on the mating plug connector.

7. The electrical receptacle connector of claim 6, wherein a contact resistance between each of the spring clips and the metal area is less than 1 milli-Ohm.

8. The electrical receptacle connector of claim 1, wherein the first side wall and the second side wall each include at least one spring clip.

9. The electrical receptacle connector of claim 1, wherein a contact force between the spring clip and the metal area is greater than 100 milligrams.

10. A USB receptacle connector for connection with a mating USB plug connector, comprising:

a body including a plurality of connection terminals;

a metal enclosure enclosing the body, the metal enclosure comprising an upper wall, a lower wall, a first side wall and a second side wall, the metal enclosure defining a space for insertion of the mating USB plug connector; and a RFI absorber enclosing outer faces of the upper wall, the lower wall, the first side wall, and the second side wall of the metal enclosure.

11. The electrical receptacle connector of claim 1, wherein the RFI absorber is composed of electroconductive rubber.

12. The electrical receptacle connector of claim 1, wherein the RFI absorber is composed of conductive fabric.

13. A USB receptacle connector, comprising:

a metal enclosure which has an upper surface and a bottom surface, both of which define at least a pair of spring clips thereon, wherein the metal enclosure further has a first side surface and a second side surface, the metal enclosure defining a space for insertion of a corresponding USB plug connector;

a body including a plurality of connection terminals, wherein the body is enclosed by the upper surface, the lower surface, the first side surface, and the second side surface of the metal enclosure; and a RFI absorber surrounding the upper surface, the lower surface, the first side surface, and the second side surface of the metal enclosure, wherein when the USB receptacle connector connects with the corresponding USB plug connector, the spring clips all contact a metal area around a perimeter of a receiving member on the USB plug connector, and wherein a ratio of length and width of each spring clip is less than or equal to 2:1.

14. The USB receptacle connector of claim 13, wherein a contact force between each spring clip and the metal area is greater than 100 milligrams and a contact resistance therebetween is less than 1 milli-Ohm.

15. The USB receptacle connector of claim 13, wherein the first side surface and the second side surface each include at least one spring clip.

16. The USB receptacle connector of claim 13, wherein each spring clip has an engaging head bending towards inside of the metal enclosure at its end, and the bending angle of the engaging head is about 45-55 degrees, to ensure that each spring clip can contact with the metal area when the USB receptacle connector connects with the corresponding USB plug connector.

17. The USB receptacle connector of claim 13, wherein the RFI absorber is composed of electroconductive rubber.

18. The USB receptacle connector of claim 10, wherein the RFI absorber is composed of conductive foam.

19. The USB receptacle connector of claim 10, wherein said USB receptacle connector includes at least two spring clips on both upper side and lower side of the metal enclosure respectively, the ratio of length and width of which is less than or equal to 2:1.

20. The USB receptacle connector of claim 10, wherein the RFI absorber is composed of electroconductive rubber.

* * * * *